US007922207B2

(12) United States Patent
Hoarau et al.

(10) Patent No.: US 7,922,207 B2
(45) Date of Patent: Apr. 12, 2011

(54) ACTIVATION AND DEACTIVATION MECHANISMS FOR MEDIA BINDERS

(75) Inventors: Eric Hoarau, Palo Alto, CA (US); Steven W. Trovinger, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 549 days.

(21) Appl. No.: 11/522,626

(22) Filed: Sep. 18, 2006

(65) Prior Publication Data

US 2008/0093836 A1 Apr. 24, 2008

(51) Int. Cl.

| | |
|---|---|
| ***B42D 1/00*** | (2006.01) |
| ***B42D 5/00*** | (2006.01) |
| ***A44B 1/04*** | (2006.01) |
| ***A44B 11/25*** | (2006.01) |
| ***A44B 17/00*** | (2006.01) |
| ***A44B 1/18*** | (2006.01) |
| ***B42F 1/00*** | (2006.01) |
| ***B42F 1/02*** | (2006.01) |
| ***A41F 1/00*** | (2006.01) |
| ***A41F 1/08*** | (2006.01) |

(52) U.S. Cl. ..... 281/21.1; 281/15.1; 24/67.5; 24/67.9; 24/456; 24/545

(58) Field of Classification Search ..... 281/21.1, 281/15.1; 402/73, 70, 500, 502; 24/67.9, 24/545, 555, 563, 456, 67.5, 67.11, 557; 269/43, 47, 303, 305, 902; 29/814
See application file for complete search history.

(56) References Cited

U.S. PATENT DOCUMENTS

| | | | | |
|---|---|---|---|---|
| 430,331 | A * | 6/1890 | Ballard | 24/456 |
| 439,994 | A * | 11/1890 | Balard | 24/456 |
| 881,514 | A | 3/1908 | Wiedeman | |
| 887,979 | A * | 5/1908 | Stockwell | 24/67.9 |
| 1,256,426 | A * | 2/1918 | Baltzley | 24/456 |
| 2,347,278 | A | 4/1944 | Pitt | |
| 3,881,203 | A * | 5/1975 | Giulie | 412/34 |
| 4,506,416 | A * | 3/1985 | Ohminato et al. | 24/67 R |

(Continued)

FOREIGN PATENT DOCUMENTS

| | | |
|---|---|---|
| CA | 2050244 | 3/1992 |

(Continued)

OTHER PUBLICATIONS

PCT/US2007/020251; Hewlett Packard Development Company, Ltd.; International Search Report; mailed Aug. 11, 2008; 7 pps.

(Continued)

*Primary Examiner* — Dana Ross
*Assistant Examiner* — Kyle Grabowski

(57) ABSTRACT

In order to provide more secure binding of physical media, activation and deactivation mechanisms for media binders are presented. As such, internal spine clamp deactivation mechanisms for deactivating a spine clamp in a media binder are presented, the mechanism including: a tension sheet configured to operate the spine clamp in response to opening the media binder in a range of approximately 270 to 360 degrees (°), normally, greater than approximately 270°; a tear line disposed along the tension sheet and oriented along the spine clamp wherein when the tension sheet is torn at the tear line, the spine clamp is deactivated. In some embodiments, the mechanism further includes a cosmetic sheet disposed between the tension sheet and a cover of the media binder for providing a cover for the spine clamp such that when the tension sheet is torn, the spine clamp remains covered.

15 Claims, 8 Drawing Sheets

U.S. PATENT DOCUMENTS

| | | | | |
|---|---|---|---|---|
| 4,986,713 | A | 1/1991 | Zoltner et al. | |
| 5,015,135 | A * | 5/1991 | Chamings | 411/447 |
| 5,035,447 | A | 7/1991 | Lolli | |
| 5,061,139 | A | 10/1991 | Zoltner | |
| 5,156,419 | A | 10/1992 | Minch | |
| 5,226,527 | A * | 7/1993 | Maurer et al. | 200/331 |
| 5,314,283 | A | 5/1994 | Zoltner | |
| 5,330,229 | A | 7/1994 | Zoltner | |
| 5,562,309 | A | 10/1996 | Brink et al. | |
| 5,574,519 | A | 11/1996 | Manico et al. | |
| 5,625,931 | A * | 5/1997 | Visser et al. | 24/557 |
| 5,685,530 | A | 11/1997 | DeLise | |
| 5,716,181 | A | 2/1998 | Ebel | |
| 5,938,241 | A | 8/1999 | Wilson | |
| 6,340,178 | B1 | 1/2002 | Nkanishi et al. | |
| 6,581,970 | B1 | 6/2003 | Lein | |
| 6,725,508 | B1 * | 4/2004 | Noda et al. | 24/545 |
| 2008/0141503 | A1 * | 6/2008 | Smith et al. | 24/455 |

FOREIGN PATENT DOCUMENTS

| | | | |
|---|---|---|---|
| EP | 0995614 | | 4/2000 |
| EP | 0995614 | A1 | 4/2000 |
| GB | 744958 | | 2/1956 |
| GB | 2145033 | | 3/1985 |
| GB | 2266866 | | 11/1993 |
| GB | 2294903 | | 5/1996 |
| JP | 2004330437 | | 11/2004 |
| JP | 2007001279 | | 1/2007 |
| WO | WO9717210 | | 5/1997 |
| WO | WO97/27066 | | 7/1997 |
| WO | WO03043834 | | 5/2003 |

OTHER PUBLICATIONS

PCT/US2007/020251; Hewlett Packard Development Company, Ltd.; Written Opinion; mailed Aug. 11, 2008; 11 pps.

* cited by examiner

ACTIVATION AND DEACTIVATION MECHANISMS FOR MEDIA BINDERS

RELATED APPLICATIONS

The present invention is related to the following commonly assigned application, the full content of which is hereby incorporated herein by reference, and entitled "MEDIA BINDER ARRANGEMENTS," filed on Jul. 21, 2006.

FIELD OF THE INVENTION

The present invention relates to mechanisms for activation and deactivation mechanisms for media binders.

BACKGROUND

Imaging systems continue to experience technological advances resulting in increased popularity and use. Some of the technological advances include substantial improvements in digital image capture devices such as digital cameras, digital video cameras, and scanning devices in terms of quality, speed, and ease of use. Other advances include improvements in digital imaging devices such as inkjet printers, laser printers, and silver halide grade photo imaging apparatus in terms of resolution, quality, and ease of use. Further, as imaging system technology matures, lower costs may be realized, which may ease entry for average consumers purchasing imaging systems.

With increased popularity and use, users of imaging systems have experienced a commensurate growth in the volume of images captured. And although these images may be conveniently stored in a memory storage device, at least some users will prefer to store their images in a printed format. For those users, a convenient and easy-to-use binder may be desirable for storing physical media.

Photo albums, scrapbooks, and the like are well-known in the art. Many schemes of securing media in such examples have been utilized. For example, some photo albums provide a number of sleeves for receiving photographs and other flat media. Scrapbooks may be configured with a "sticky" page to which a photo or memento may be attached and which may then be covered with an acetate sheet. In still other examples, fixed size sleeves, screw posts, and such clamping devices may be utilized to secure photographs and other flat media.

As such, activation and deactivation mechanisms for media binders are presented herein.

SUMMARY

The following presents a simplified summary of some embodiments with features of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

In order to provide more secure binding of physical media locking mechanisms for media binders are presented. As such, internal spine clamp deactivation mechanisms for deactivating a spine clamp in a media binder are presented, the mechanism including: a tension sheet configured to operate the spine clamp in response to opening the media binder in a range of approximately 270 to 360 degrees (°), normally, greater than approximately 270°; and a tear line disposed along the tension sheet and oriented along the spine clamp wherein when the tension sheet is torn at the tear line, the spine clamp is deactivated. In some embodiments, the mechanism further includes a cosmetic sheet disposed between the tension sheet and a cover of the media binder for providing a cover for the spine clamp and attaching the clamp mechanism to the cover of the media binder such that when the tension sheet is torn, the spine clamp remains covered.

In other embodiments, external spine clamp activation mechanisms for activating a spine clamp in a media binder are presented, the mechanism including: a back plate, the back plate configured with a first lateral edge and a second lateral edge wherein the back plate is substantially planar; a first side plate disposed along the first lateral edge wherein the first side plate is substantially perpendicular to the back plate; and a second side plate disposed along the second lateral edge wherein the second side plate is substantially perpendicular to the back plate such that the back plate, the first side plate, and the second side plate defining a cavity for receiving a back edge of the media binder such that the spine clamp is operative for opening only when the mechanism is engaged with the back edge. In some embodiments, the mechanism further comprises: a first finger indent disposed along the first side plate, the first finger indent defining a concave groove disposed along an outside length of the first side plate; and a second finger indent disposed along the second side plate, the second finger indent defining a concave groove disposed along an outside length of the second side plate. In some embodiments, the first side plate and the second side plate are configured with a textured surface to provide an improved gripping surface. In some embodiments, the mechanism is configured to allow the spine clamp to be operative for opening over a range of approximately 270° to 360°.

In some embodiments, external spine clamp activation mechanisms for activating a spine clamp in a media binder are presented, the mechanism including: two opposing side plates attached by a flexible bridge element which extends medially along the two opposing side plates, the two opposing sides defining an open cavity for receiving a back edge of the media binder along a distal edge of the mechanism such that the spine clamp is operative for opening only when the mechanism is engaged with the back edge; and a number of grabbing elements disposed along a proximal edge of the mechanism wherein when the number of grabbing elements are compressed, the two opposing side plates are further separated along the distal edge. In some embodiments, the two opposing side plates include an elbow portion for providing rigidity to the mechanism. In some embodiments, the mechanism is formed as a unitary thermo-plastic molding. In some embodiments, the mechanism is formed as a multi-piece design.

In some embodiments, an internal spine lock mechanism for activating a spine claim in a media binder are presented, including a bottom plate, the bottom plate configured to slidingly receive a sliding lock assembly, the sliding lock assembly having a slide plate for extending the sliding lock assembly from the bottom plate; a spacer disposed along an edge of the slide plate for activating the spine clamp when the sliding lock assembly is extended from the bottom plate, a locking pin for providing a positive stop for the slide plate; and a top plate for enclosing the sliding lock assembly, the top plate including a guide channel for receiving the locking pin.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF EMBODIMENTS OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1A:
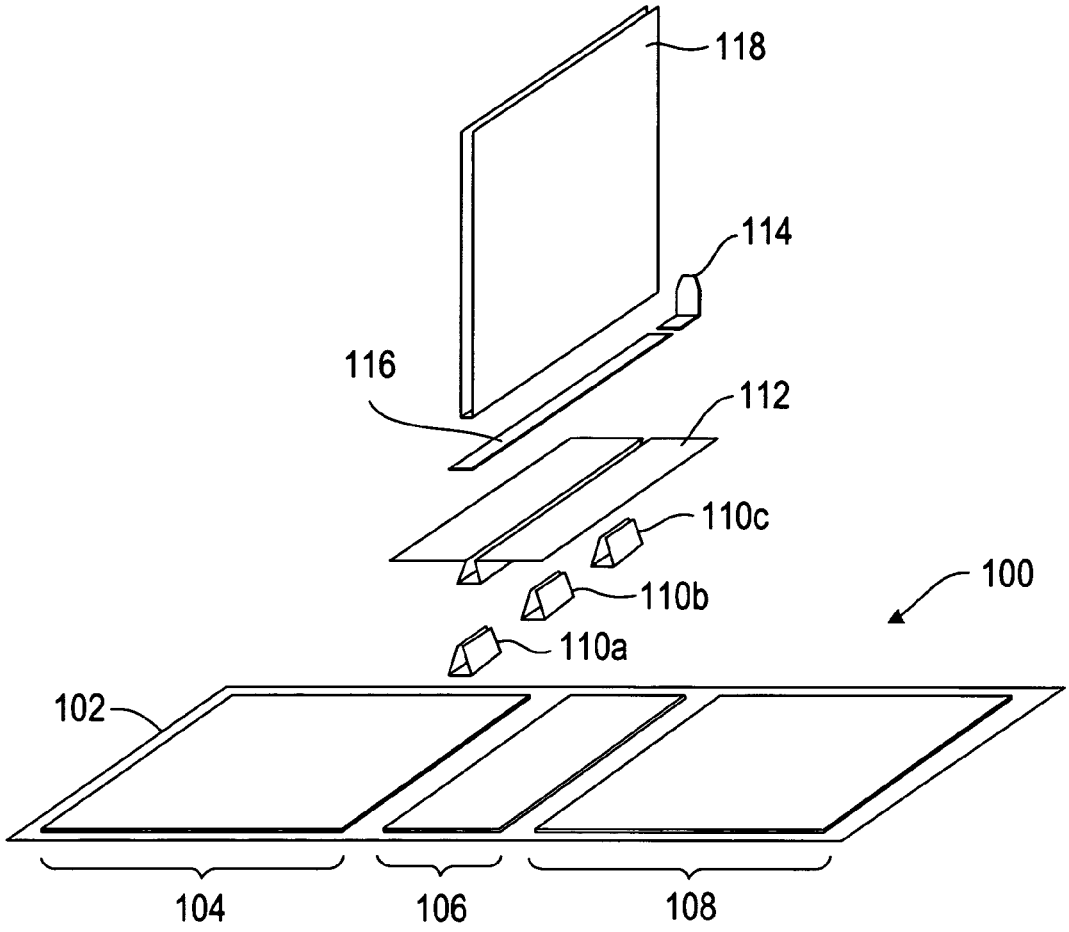
FIGS. 1A-B are illustrative representations of a media binder.
Figure 1B:
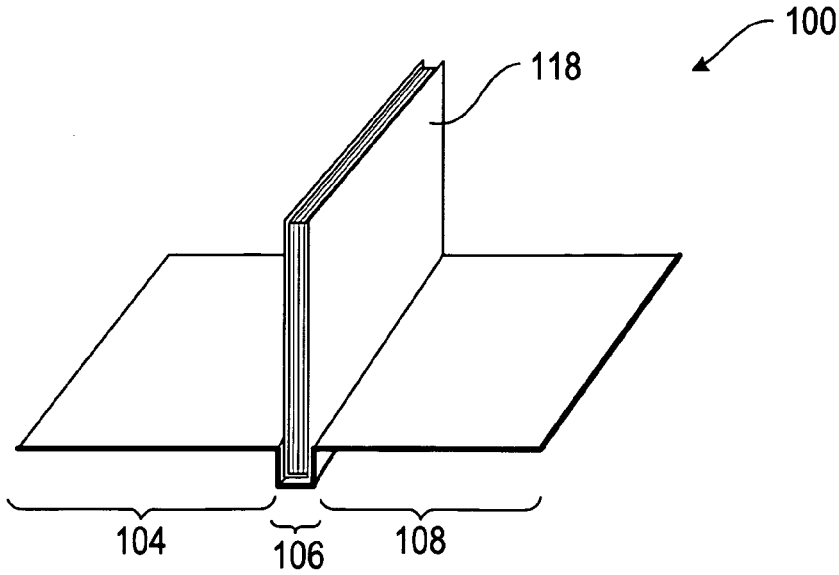

In a related application entitled, "MEDIA BINDER ARRANGEMENT," easy-to-use media binder arrangements for securely clamping and aligning physical media are presented such as depicted in FIGS. 1A-B. FIG. 1A is an illustrative representation of an exploded view of a media binder 100. Media binder 100 includes a cover 102 that includes a front planar surface 104, a spine planar surface 106, and a back planar surface 108. Media binder 100 further includes one or more spine clamps 110*a*, 110*b*, and 110*c*. Media binder 100 further includes tension sheet 112. Tension sheet 112 operates to transmit an opening force to one or more spine clamps such as spine clamps 110*a*, 110*b*, and 110*c*. In order to transmit an opening force to one or more spine clamps, tension sheet 112 may be bonded to a spine clamp as well as to cover 102. When cover 102 is opened to a position in a range of approximately 270 to 360 degrees (°), normally, greater than approximately 270°, an opening force is transmitted to one or more spine clamps such as spine clamps 110*a*, 110*b*, and 110*c* by the tension sheet 112 whereupon media may be inserted or removed. Media binder 100 further includes datum stop 114. Datum stop 114 may be provided to easily align physical media being clamped. In some embodiments, a datum spacer 116 may be utilized in coordination with datum stop 114. Datum spacer 116 may be co-planer with respect to datum stop 114. In some embodiments, media binder 100 may optionally include protective sheet 118. In some embodiments, protective sheets include any number of mediums such as papers and films, or preferably, a translucent or transparent material such as an acetate, a polymeric film, or vellum without departing from the present invention. Protective sheet 118 may be utilized to protect secured physical media from inadvertent damage caused by opening and closing cover 102, and/or to protect exposed media against degradation due to natural elements (e.g., light and water). FIG. 1B is an illustrative representation of an assembled media binder 100. FIG. 1B is provided for clarity in understanding assembled embodiments of the present invention including embodiments described above for FIG. 1A, and wherein same reference numbers refer to like elements.

As may be appreciated media binders, such as that depicted in FIGS. 1A-B may be useful for binding any number of types of media. However, in some use cases, it may be desirable to permanently secure media, or, at a minimum, to better control the insertion or removal of media. By way of example, an elementary school teacher may desire to provide bound media for young students. By deactivating a media binder having bound media, the teacher may assure that media will remain bound against accidental loss due in part to careless handling by inexperienced students. In another example, a user may wish to more permanently bind media in order to reduce risk of theft of bound media. This example may find particular relevance where a media binder is generally and publicly accessible.

Figure 2A:
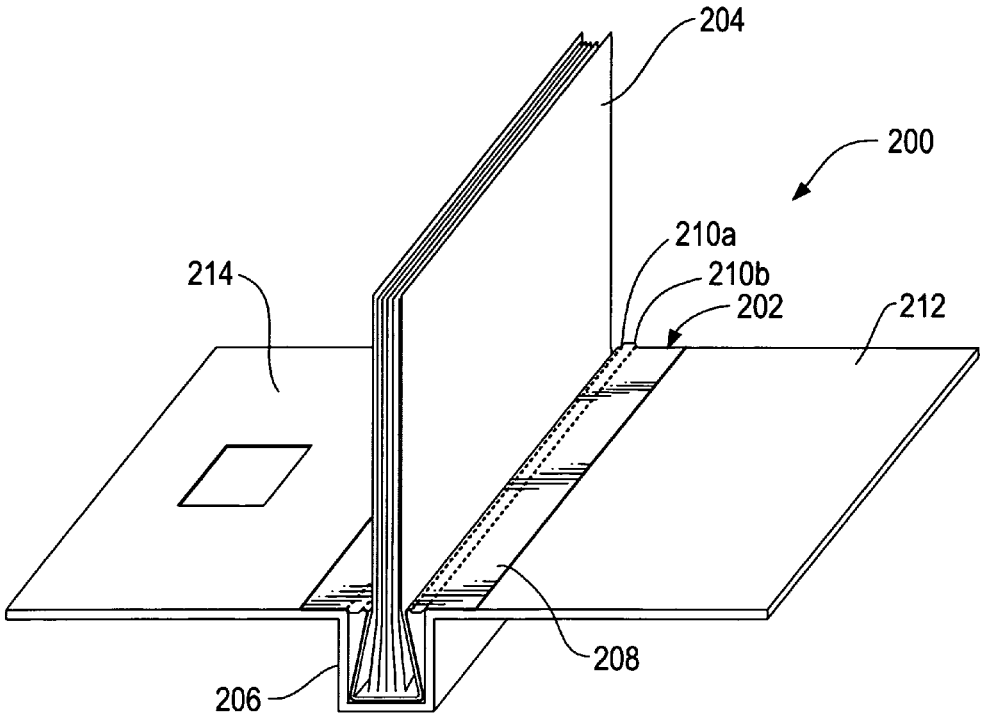
FIGS. 2A-B are illustrative representations of an internal spine clamp deactivation mechanism embodying features of the present invention.
Figure 2B:
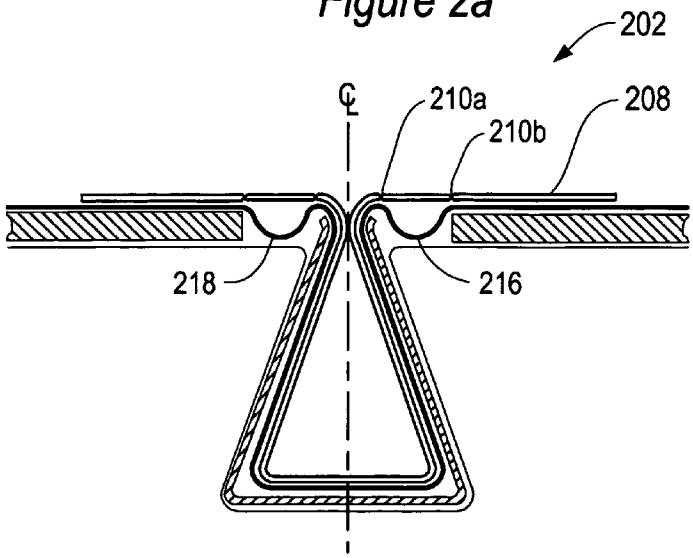

FIGS. 2A-B are illustrative representations of an internal spine clamp deactivation mechanism embodying features of the present invention. As illustrated, media binder 200 may include a spine clamp 206 for securing media 204. A tension sheet 208 is utilized to transfer an opening force to spine clamp 206 when covers 212 and 214 are opened to a position in a range of approximately 270 to 360 degrees (°), normally, greater than approximately 270°. Internal spine clamp deactivation mechanism 202 may further include tear line 210*a* disposed along tension sheet 208 and oriented along spine clamp 206. When tear line 210*a* is cut or otherwise separated in some manner, tension sheet 208 can no longer function to operate spine clamp 206. In some embodiments, tear line 210*a* is perforated. In some embodiments, internal spine clamp deactivation mechanism 202 further includes a tear cord (not shown) that is disposed under tear line 210*a*. When a user grasps and pulls the tear cord, then the tear line is cut by the action of removing the tear cord. In this manner, a spine clamp may be conveniently deactivated. As may be seen in FIGS. 2A and 2B, in some embodiments, more than one tear line (i.e. 210*b*) may be utilized. When more than one tear line is utilized, a portion of tension sheet may be removed when tear lines 210*a* and 210*b* are torn. In those embodiments, a cosmetic sheet 216 may be utilized to provide a cover for spine clamp 206. In other embodiments, a second cosmetic sheet 218 may be utilized.

Figure 3A:
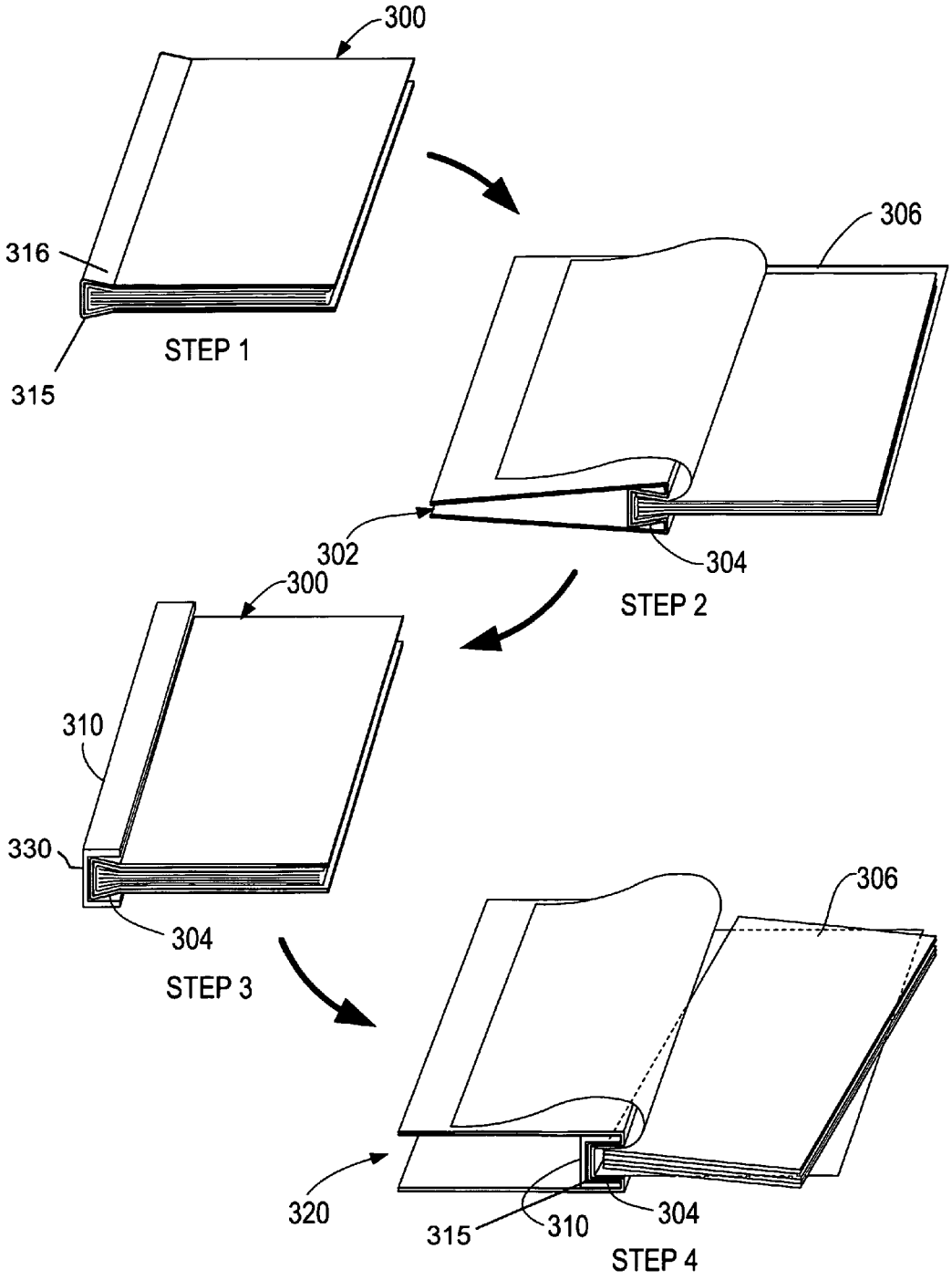
FIGS. 3A-C are illustrative representations of an external spine clamp activation mechanism embodying features of the present invention.
Figure 3B:
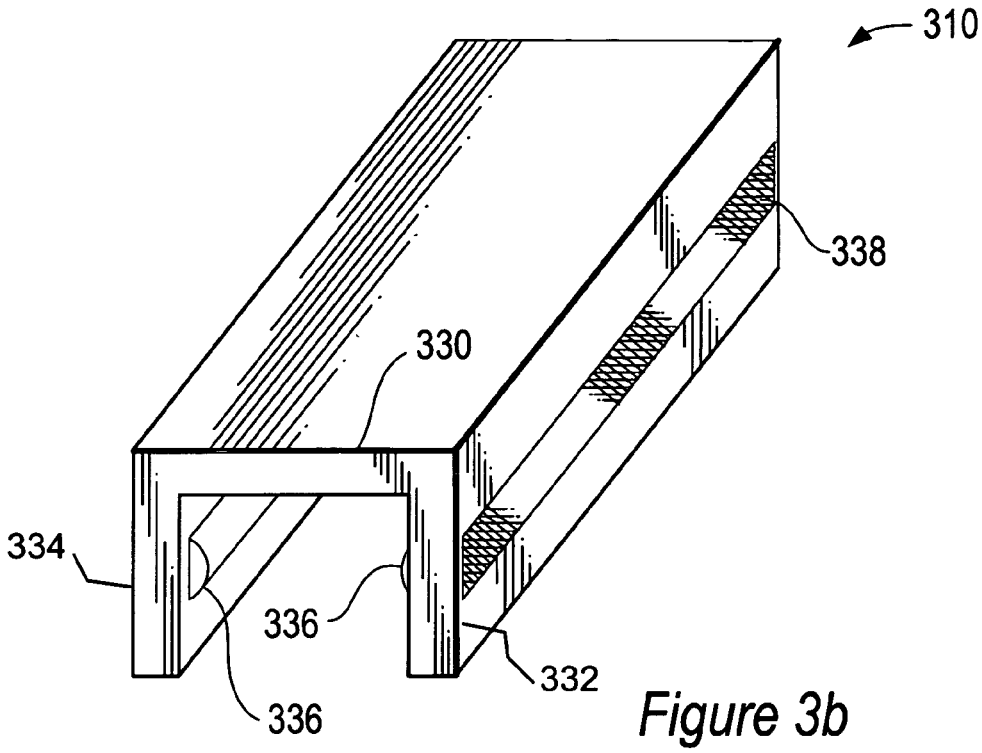
Figure 3C:
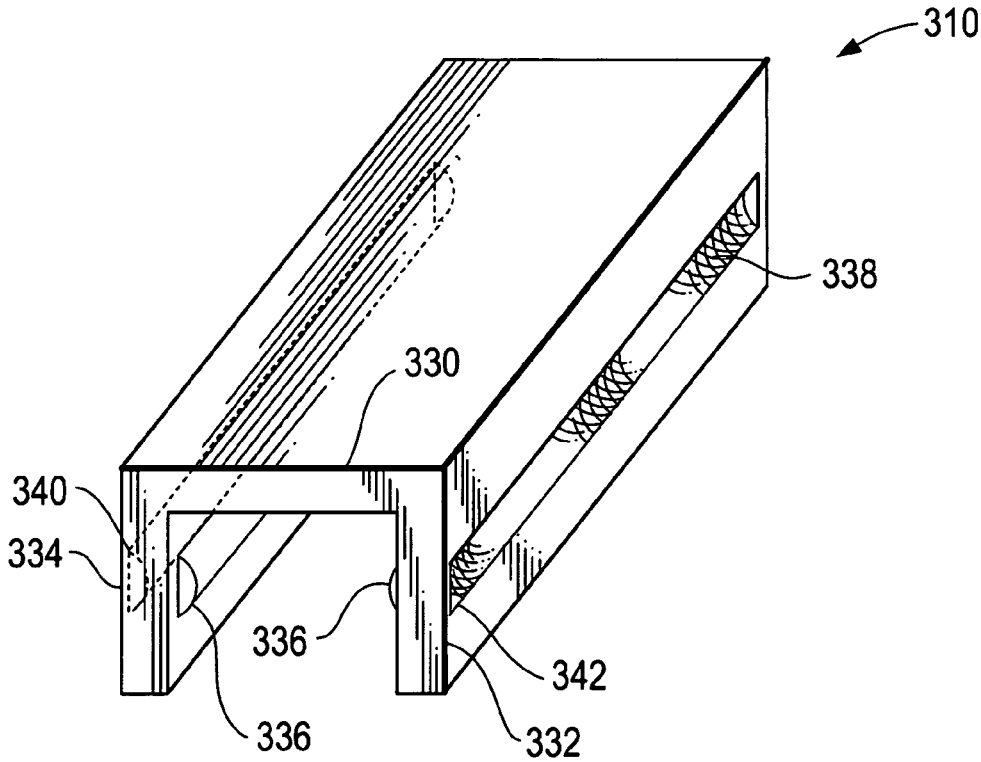

FIGS. 3A-C are illustrative representations of an external spine clamp activation mechanism 310 embodying features of the present invention. As illustrated in FIG. 3A, at STEP 1, a media binder 300 is in a closed position. Of course, it should be noted that according to an embodiment as shown, the spine clamp is inactivated regardless of the position of the binder cover. At a STEP 2, media binder 300 is in a fully opened position 302. When spine clamp activation mechanism 310 is absent, media 306 may not be removed from media binder 300, because spine clamp 304 is not activated. However, at a STEP 3, spine clamp activation mechanism 310 may be engaged with media binder 300 along media binder's back edge 315 (as shown in FIG. 3A). In an embodiment, as shown, the spine clamp activation mechanism 310 may be engaged with media binder 300 along media binder's back and front edges, 315 and 316. Subsequently, at a STEP 4, when media binder 300 is in fully opened position 320, spine clamp 304 is engaged and media 306 may be inserted into or removed from media binder 300. In one embodiment, external spine clamp activation mechanism is configured to activate spine clamp 304 over an opened position range of approximately 270° to 360°.

FIG. 3B is a further detailed orthogonal representation of an external spine clamp activation mechanism 310 embodying features of the present invention. External spine clamp activation mechanism 310 may be configured with a back plate 330 that is substantially planar and two side plates 332 and 334 that are disposed to engage media binder 300 along media binder's back edge. In one embodiment, the side plates are substantially perpendicular to the back plate 330. In some embodiments, external spine clamp activation mechanism 310 may be configured with tabs 336. Tabs 336 provide a positive stop for the mechanism and are configured to mate with along either or both the back edge 315 and front edge 316 of media binder 300. In some embodiments, an audible click may serve to inform a user that the external spine clamp activation mechanism is correctly placed. In other embodiments, media binder 300 may be configured with a groove or channel (not shown) to slidingly receive external spine clamp activation mechanism 310. In other embodiments, tabs 336 may also mate with indents (not shown) along the front edge of media binder 300. In this manner, media binder 300 may be conveniently secured against accidental opening.

In some embodiments, external spine clamp activation mechanism 310 may be configured with a textured surface 338. Textured surface 338 may provide an improved gripping surface that may be especially useful when removing the lock. As may be appreciated, textures may be formed on the surface of the side plates or may be applied to the surface of the side plates without departing from the present invention. Further, as may be appreciated, external spine clamp locks may be manufactured from any number of compositions without departing from the present invention including: a substantially inelastic material; a substantially inelastic polymer, a metal, a spring steel composition, and an organic fiber composition. In an embodiment, the substantially inelastic composition allows for the flexing of the two side plates of the lock to allow the binder to open. In an embodiment, the back plate is formed from an inelastic material.

In some embodiments, as illustrated in FIG. 3C, external spine clamp activation mechanism 310 may be optionally configured with finger indents 340 and 342 as represented by broken lines without departing from the present invention. Finger indents 340 and 342 represent a lengthwise concave groove or channel on side plates 334 and 332 respectively. Finger indents may provide an improved gripping surface for external spine clamp activation mechanism 310 such that the mechanism may be more easily removed and engaged. As may be appreciated, any number of profiles for finger indents may be utilized without departing from the present invention. Furthermore, in some embodiments, finger indents 340 and 342 may be configured with a textured surface 338 thus providing a further improved gripping surface.

Figure 4A:
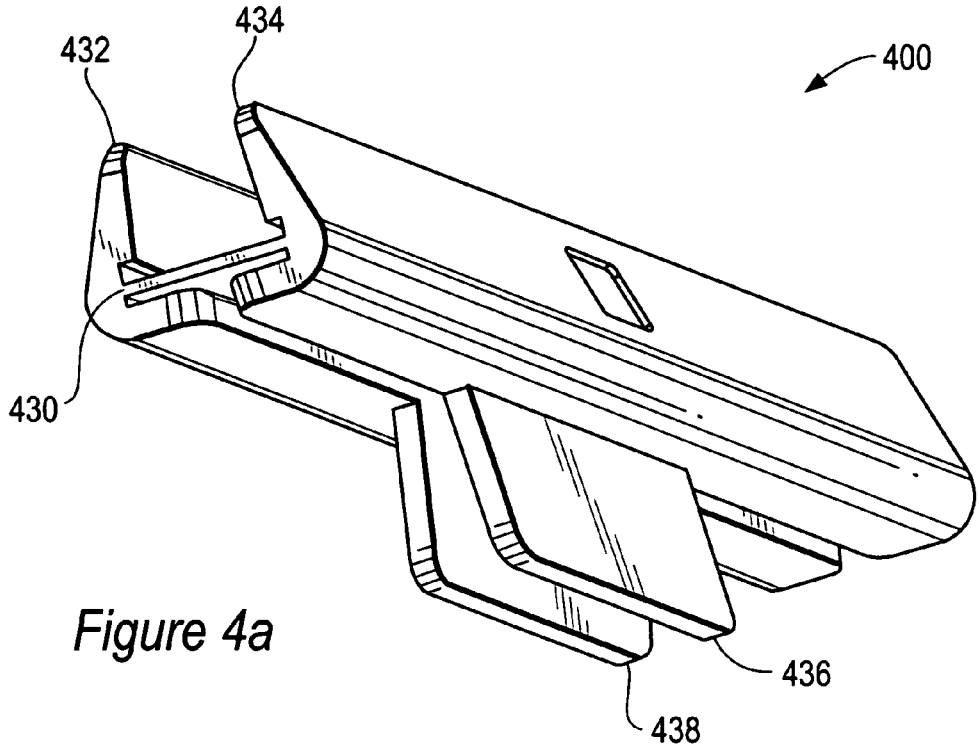
FIGS. 4A-B are illustrative representations of an external spine clamp activation mechanism embodying features of the present invention.
Figure 4B:
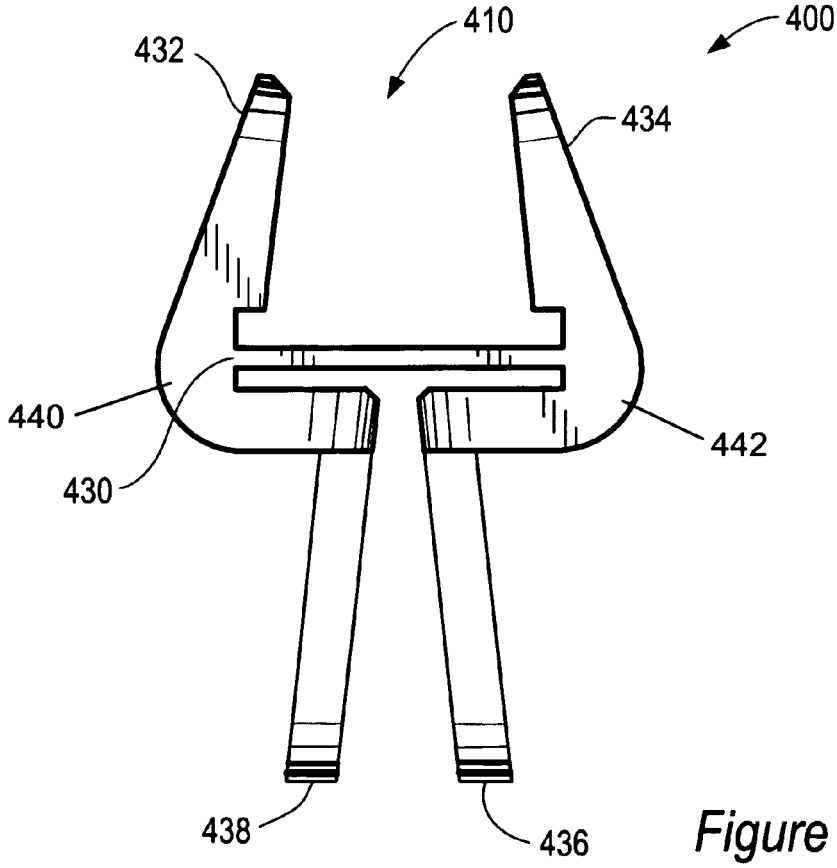

FIGS. 4A-B are illustrative representations of an external spine clamp activation mechanism 400 embodying features of the present invention. Mechanism 400 includes opposing sides 432 and 434 which may be utilized to engage an edge of a media binder. In one embodiment, mechanism 400 may be utilized to engage the back edge 315 (FIG. 3) of a media binder 300 (FIG. 3) in order to activate an associated spine clamp. In another embodiment, mechanism 400 may be utilized to engage the front edge of a media binder in order to secure the cover of the media binder. Opposing sides 432 and 434 may be attached with flexible bridge element 430. Opposing sides 432 and 434 may also be attached with grabbing elements 436 and 438. Thus, when a user applies a compression force to grabbing elements 436 and 438, flexible bridge element 430 operates to further spread opposing sides 432 and 434 whereupon the mechanism may be engaged with a media binder. Flexible bridge element 430 further provides holding tension once the mechanism is engaged with a media binder. Once mechanism 400 is engaged with a media binder, an associated spine clamp may be activated to operate over a range of approximately 270° to 360° (see FIG. 3A: STEP 4).

In some embodiments, grabbing elements 436 and 438 may be configured with a textured surface (not shown) to provide an improved gripping surface.

FIG. 4B is a cross-sectional representation of mechanism 400. As may be seen an open cavity 410 is defined by opposing sides 432 and 434 such that a substantially U-shaped cross section is achieved. In some embodiments, opposing sides 432 and 434 may be configured with elbow portions 440 & 442 to provide structural rigidity to the mechanism. As may be appreciated, any number of compounds may be utilized to form the mechanism without departing from the present invention. In one embodiment, the mechanism is formed as a unitary thermo-plastic molding. In an embodiment, the mechanism may be formed from different pieces, as for example, two side planes made from a hard plastic and as a spring member made from spring metal or other shape memory material.

Figure 5A:
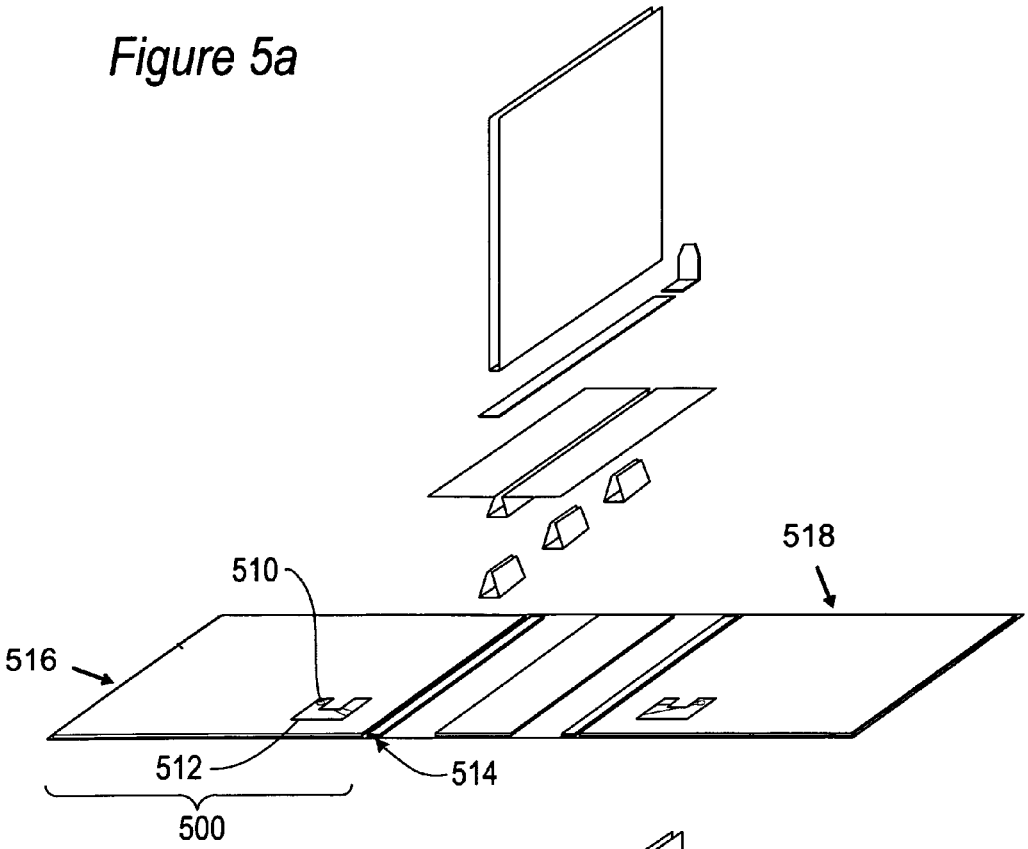
FIGS. 5A-G are illustrative representations of an internal spine clamp
Figure 5B:
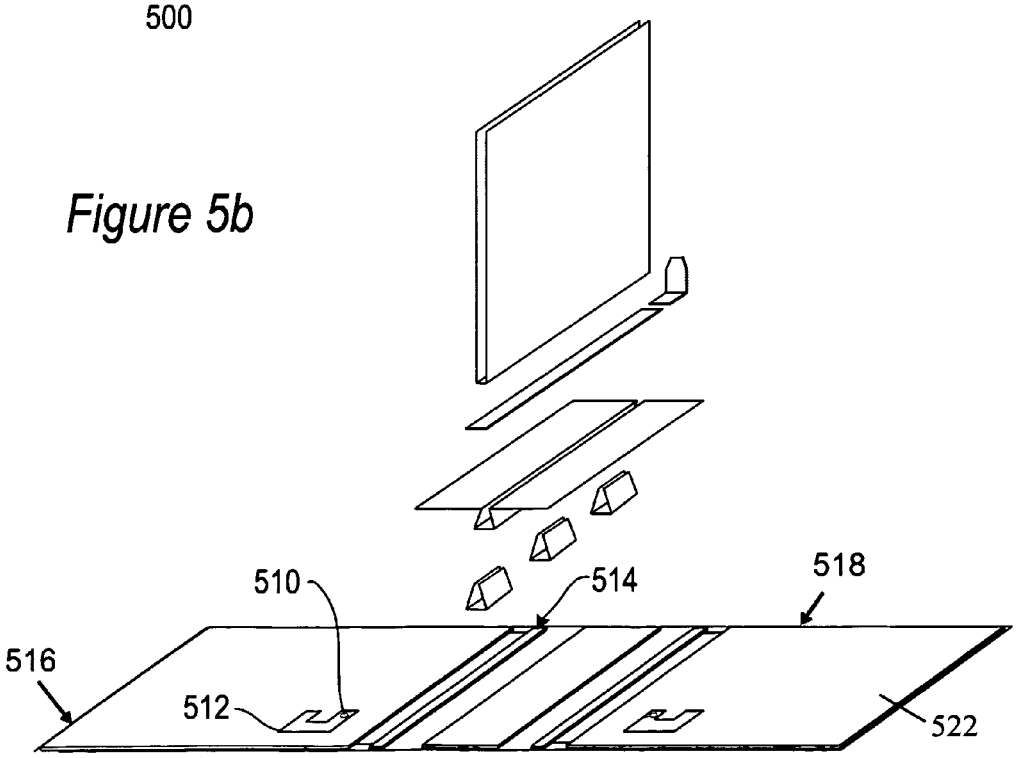
Figure 5C:
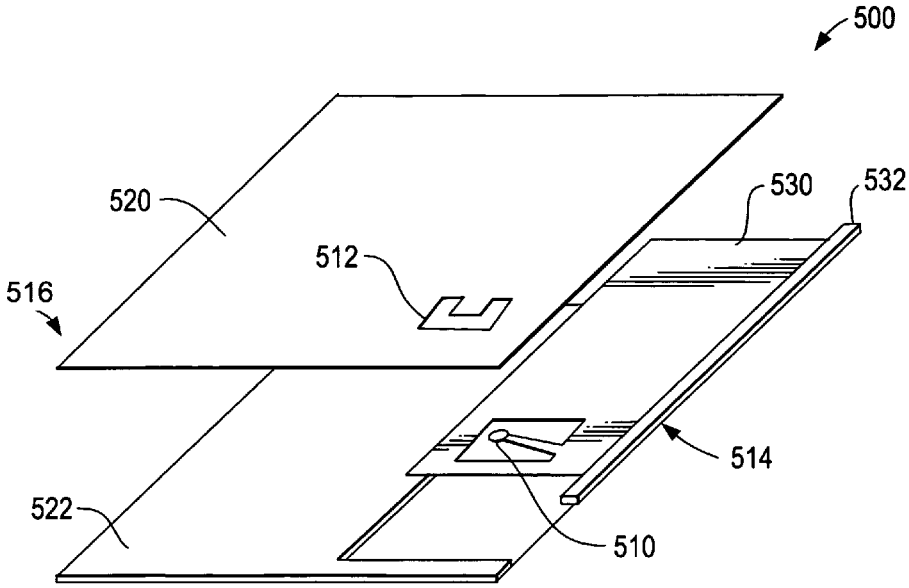

FIGS. 5A-G are illustrative representations of an internal spine clamp activation mechanism 500 embodying features of the present invention. FIG. 5A is an illustrative representation of internal spine clamp activation mechanism 500 in an inactivated position. FIG. 5B is an illustrative representation of the internal spine clamp activation mechanism 500 in an activated position. As illustrated in FIG. 5B, the sliding lock mechanism 514 is in an extended position. Sliding lock mechanism 514 will be described in further detail below. FIGS. 5A-B are provided for clarity in understanding embodiments of the present invention. FIG. 5C is an exploded view of an internal spine clamp activation mechanism 500. Internal spine clamp activation mechanism 500 includes top plate 520 and bottom plate 522 for slidingly receiving sliding lock assembly 514. In some embodiments, bottom plate 522 is further configured to provide an outer surface for cover 516. Sliding lock assembly 514 includes slide plate 530 for extending sliding lock assembly 514 from the bottom plate 522. In one embodiment, bottom plate 522 and sliding lock assembly 514 are substantially coplanar. Sliding lock assembly 514 further includes spacer 532 which is attached along an edge of slide plate 530. Spacer 532 serves to activate a spine clamp which will be discussed in further detail below for FIGS. 5D-G. In order to provide a positive stop for sliding lock assembly 514, locking pin 510 may be provided. Locking pin 510 may be moved along guide channel 512 of top plate 520. Locking pin 510 may also be configured to provide a retention mechanism for sliding lock assembly 514. As may be appreciated, sliding lock assembly may be formed from any of a number of well-known compositions without departing from the present invention. In one embodiment, sliding lock assembly 514 is formed from a substantially inelastic polymeric compound.

Figure 5D:
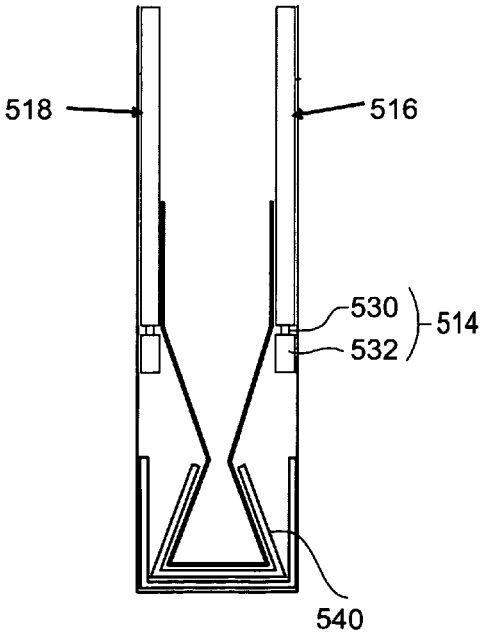
Figure 5E:
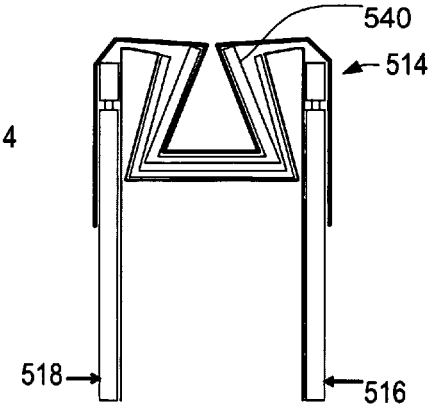

FIGS. 5D-G provide illustrative representations of internal spine clamp activation mechanisms 500 in various positions. FIG. 5D represents a media binder having an internal spine clamp activation mechanism 500 in an inactivated position with the media binder in a fully closed position. As illustrated, slide plate 530 is nested in cover 516 (between top plate 520 and bottom plate 522). As shown, spacer 532 is in a retracted position. FIG. 5E represents a media binder having an internal spine clamp activation mechanism in an inactivated position with the media binder in a fully opened position. As illustrated, when sliding lock assembly 514 is retracted, spine clamp 520 is inactive. That is, opening covers 516 and 518 to a range of approximately 270° to 360° will not serve to open spine clamp 520. In the inactivated position, locking pin 510 is positioned in guide channel 512 as illustrated in FIG. 5A.

Figure 5F:
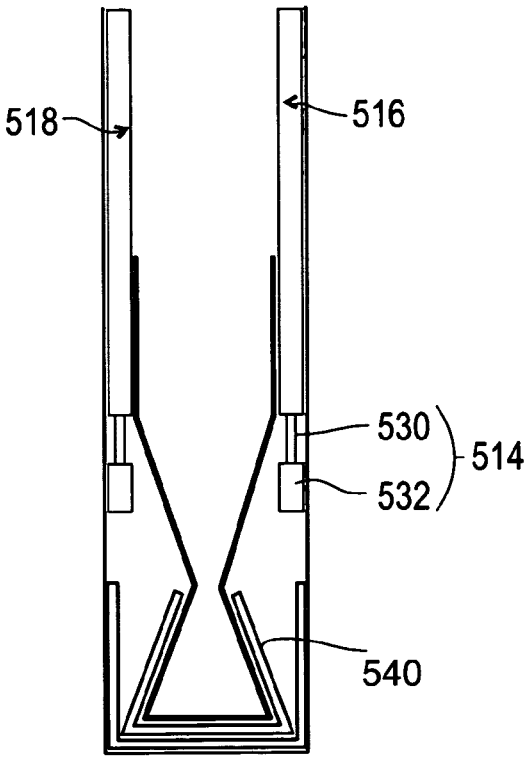
Figure 5G:
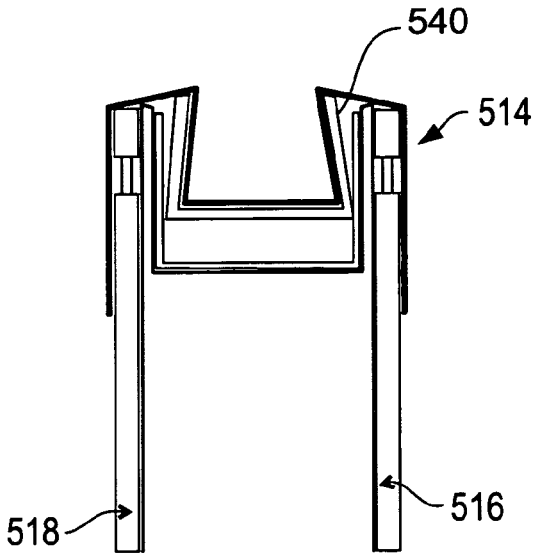

FIG. 5F represents a media binder having an internal spine clamp activation mechanism 500 in an activated position with the media binder in a fully closed position. As illustrated, slide plate 530 is extended from cover 516. As such, spacer 532 is in an extended position. FIG. 5G represents a media binder having an internal spine clamp activation mechanism in an activated position with the media binder in an opened position. As illustrated, when sliding lock assembly 514 is in an extended position, spine clamp 520 is activated. That is, opening covers 516 and 518 to a range of approximately 270° to 360° will serve to open spine clamp 520. In the activated position, locking pin 510 is positioned in guide channel 512 as illustrated in FIG. 5B.

While this invention has been described in terms of several preferred embodiments, there are alterations, permutations, and equivalents, which fall within the scope of this invention. It should also be noted that there are many alternative ways of implementing the methods and apparatuses of the present invention. Although various examples are provided herein, it is intended that these examples be illustrative and not limiting with respect to the invention. Further, the abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A mechanism, comprising:

a spine clamp in a media binder; and an external spine clamp activation mechanism that includes:

a back plate, the back plate configured with a first lateral edge and a second lateral edge wherein the back plate is substantially planar;

a first side plate disposed along the first lateral edge wherein the first side plate is substantially perpendicular to the back plate;

a second side plate disposed along the second lateral edge wherein the second side plate is substantially perpendicular to the back plate such that the back plate, the first side plate, and the second side plate define a cavity that receives a back edge of the media binder such that the spine clamp opens only when the external spine clamp activation mechanism is engaged with the back edge; and wherein the first and second side plates are spaced apart from one another by a first distance when the back edge of the media binder is received within the cavity and the external spine clamp activation mechanism is engaged with the back edge of the media binder to render the spine clamp operative for opening, and wherein the first and second side plates are spaced apart from one another by a second distance greater than the first distance to provide the external spine clamp activation mechanism in a state which permits the external spine clamp activation mechanism to receive the back edge of the media binder within the cavity and to engage the back edge of the media binder.

2. The mechanism of claim 1, wherein the external spine clamp activation mechanism receives a front edge of the media binder such that the media binder is securely closed when the external spine clamp activation mechanism is engaged with the front edge.

3. The mechanism of claim 1, wherein the first and second side plates are spaced apart from one another by the second distance to provide the external spine clamp activation mechanism in the state which permits the external spine clamp activation mechanism to receive the back edge of the media binder from a non-engaged state where no portion of the media binder is within the cavity.

4. The mechanism of claim 1, wherein interior surfaces of the first and second side plates only engage exterior portions of the media binder.

5. The mechanism of claim 1, wherein interior surfaces of the first and second side plates only engage portions of the media binder that are external of a media receiving portion of the media binder.

6. The mechanism of claim 1, wherein the external spine clamp activation mechanism, when the back edge of the media binder is received within the cavity of the external spine clamp activation mechanism, only opens the spine clamp as a result of front and back cover portions of the media binder being opened with respect to one another.

7. The mechanism of claim 1, wherein the external spine clamp activation mechanism does not contact media when the media binder is in a media changing state where the media may be inserted into or removed from the media binder.

8. The mechanism of claim 1, wherein no portion of the external spine clamp activation mechanism is provided within a media binding portion of the media binder.

9. The mechanism of claim 1, wherein no portion of the external spine clamp activation mechanism is provided within a media binding portion of the media binder when the external spine clamp activation mechanism is engaged with the back edge of the media binder.

10. A mechanism, comprising:

a spine clamp in a media binder; and an external spine clamp activation mechanism that includes:

at least two opposing side plates attached by a flexible bridge element that extends medially along the at least two opposing side plates, the at least two opposing sides defining an open cavity for receiving a back edge of the media binder such that the spine clamp opens only when the external spine clamp activation mechanism is engaged with the back edge; and a plurality of grabbing elements disposed along a proximal edge of the external spine clamp activation mechanism wherein when the plurality of grabbing elements are compressed, the at least two opposing side plates are further separated, wherein the external spine clamp activation mechanism is formed as a unitary thermo-plastic molding.

11. The mechanism of claim 10, wherein the at least two opposing side plates include an elbow portion for providing rigidity to the external spine clamp activation mechanism.

12. The mechanism of claim 10, wherein the open cavity defines a substantially U-shaped cross section.

13. The mechanism of claim 10, wherein the plurality of grabbing elements are configured with a textured surface to provide an improved gripping surface.

14. The mechanism of claim 10, wherein the two opposing plates are further separated from one another compared with a moment in time when the grabbing elements are not compressed.

15. The mechanism of claim 10, wherein the at least two opposing side plates do not contact media when the media binder is in a media changing state where the media may be inserted into or removed from the media binder.

* * * * *